US005578411A

United States Patent [19]

Slater et al.

[11] Patent Number: 5,578,411

[45] Date of Patent: Nov. 26, 1996

[54] RAPID-ACCESS MEDICAL X-RAY FILM AND PROCESS

[75] Inventors: Sean D. Slater, Hitchin; Julian M. Wallis, Harlow, both of Great Britain

[73] Assignee: Imation Corp., Woodbury, Minn.

[21] Appl. No.: 194,249

[22] Filed: Feb. 10, 1994

[30] Foreign Application Priority Data

Mar. 16, 1993 [GB] United Kingdom ..... 9305315

[51] Int. Cl.[6] ..... G03C 5/29

[52] U.S. Cl. ..... 430/139; 430/413; 430/415; 430/448; 430/566; 430/963; 430/966; 430/967

[58] Field of Search ..... 430/139, 523, 430/963, 966, 967, 413, 415, 448, 566

[56] References Cited

U.S. PATENT DOCUMENTS

| | | | |
|---|---|---|---|
| 3,737,313 | 6/1973 | Rosecrants et al. . | |
| 4,211,561 | 7/1980 | Plambeck, Jr. | 430/380 |
| 4,713,323 | 12/1987 | Maskasky | 430/567 |
| 4,783,398 | 11/1988 | Takada et al. | 430/567 |
| 5,028,520 | 7/1991 | Ito | 420/567 |

FOREIGN PATENT DOCUMENTS

| | | |
|---|---|---|
| 0281179 | 9/1988 | European Pat. Off. . |
| 3023099 | 1/1981 | Germany . |

*Primary Examiner*—Hoa Van Le
*Attorney, Agent, or Firm*—Mark Litman; Gregory A. Evearitt

[57] ABSTRACT

A medical X-ray film comprising a transparent base coated on at least one side with (a) a laminar grain silver halide emulsion and (b) a separate hydrophillic colloid layer containing a developing agent for silver halide in an amount corresponding to at least 0.5 moles per mole of the silver coated on that side of the base.

10 Claims, No Drawings

RAPID-ACCESS MEDICAL X-RAY FILM AND PROCESS

FIELD OF THE INVENTION

This invention relates to medical X-ray films and to their processing. In particular the invention relates to medical X-ray films having significantly reduced processing time.

BACKGROUND TO THE INVENTION

Medical X-ray films typically comprise a transparent substrate coated on one or both sides with a light sensitive silver halide emulsion. Exposure is effected by means of fluorescent screens placed in contact with the emulsion-coated side(s) of the film. The screens absorb a proportion of the X-rays impinging on them and re-emit the energy as visible light, normally in the green portion of the spectrum, and the emulsions are sensitised accordingly. Laminar grain emulsions are increasingly used for X-ray films because of their ability to reduce crossover, i.e. the exposure of an emulsion on one side of the base by light emitted by the screen on the other side of the base. Although crossover decreases the overall exposure required to achieve a given Dmax, it degrades significantly the image resolution. Laminar emulsions have the desirable properties of reducing crossover without undue loss of speed. Even in the case of single-sided X-ray films, laminar emulsions are preferred because they enable the use of reduced amounts of silver. Dye-containing underlayers situated between the base and the emulsions are also frequently used to reduce crossover and halation in double-sided films. In single-sided films, an antihalation layer is normally coated on the back. Protective layers, e.g. of hardened gelatin, are normally coated on top of the emulsions to improve the durability of the film.

The exposed films are typically processed by immersion in warm (about 35° C.) alkaline developer solution containing developing agents e.g. hydroquinone, phenidone etc., stabiliser e.g. sulphite ion, antifoggants and a hardener e.g. a dialdehyde, such as, glutaraldehyde. Thereafter, the film is fixed, washed and dried, the entire process taking in the region of 90 to 110 seconds dry-to-dry, or longer. There is increasing interest in reducing this time to less than 60 seconds, preferably less than 45 seconds, in the interests of improved productivity, especially during mass screenings. Possible means for reducing the processing time include the use of more concentrated developer solutions and/or higher temperatures, both of which are undesirable from an environmental point of view.

The incorporation of developing agents into photographic elements is disclosed widely in the literature. In most cases the developers are incorporated in the emulsion layer itself, but the possibility of incorporation in an adjacent layer is often mentioned. The bulk of the prior art relating to incorporated developers is directed to graphic arts films and plates involving high-chloride non-laminar-grain emulsions, with the object of reducing the amount of noxious chemicals the user must handle before, during and after the processing stage. Also, by using an activator, rather than a developer as the processing solution, replenishment/replacement during continuous operation is less critical.

JP01-072141 and U.S. Pat. No. 5,028,520 disclose photographic elements comprising a laminar silver halide emulsion and a polyhydroxybenzene incorporated in the emulsion or in an associated hydrophillic colloid layer. U.S. Pat. No. 5,028,520 relates specifically to X-ray film. The Japanese application specifies a maximum concentration of 0.1 mole/mole Ag for the polyhydroxybenzene and claims a reduction in stress-sensitivity, while the U.S. patent specifies a concentration in the range 0.03 to 0.50 moles/mole Ag and claims a reduction in reflectivity of the developed silver image. The preferred concentration range disclosed is 0.03 to 0.30 moles/mole Ag, and most preferred 0.05 to 0.10. Processing is by conventional developer solutions. In both cases, the formula for the polyhydroxybenzenes encompasses compounds such as resorcinols. There is no disclosure of the presence of auxiliary developers, such as phenidone, in the films.

It has now been found that the use of incorporated developing agents, present in a layer separate from the emulsion, in an X-ray film having a laminar grain silver halide emulsion, enables rapid processing in simple activator solution. Surprisingly, this is achieved without detriment to the sensitometry of the film.

BRIEF SUMMARY OF THE INVENTION

According to one embodiment of the present invention there is provided a method of forming an image comprising the steps of:

1. providing an X-ray film comprising a transparent base coated on at least one side with (a) a laminar grain silver halide emulsion and (b) a separate hydrophillic colloid layer containing a developing agent for silver halide, 2. positioning a light-emitting phosphor screen in intimate contact with each emulsion-coated side of the film, 3. imagewise exposing the phosphor screen to X-rays, and 4. contacting the exposed film with an aqueous alkaline activator solution to develop an image.

According to a second embodiment of the invention there is provided a medical X-ray film comprising a transparent base coated on at least one side with (a) a laminar grain silver halide emulsion and (b) a separate hydrophillic colloid layer containing a developing agent for silver halide in an amount corresponding to at least 0.5 moles per mole of the silver coated on that side of the base.

The invention enables X-ray images to be produced with greatly reduced processing time, e.g. about 45 seconds, without recourse to high temperatures or high concentrations of noxious chemicals. A further advantage is a more consistent sensitometric response. Because each film contains its own complement of fresh developer, large numbers of films can be processed in identical fashion through the same solution. In conventional systems, the developer solution becomes progressively depleted and must be replenished periodically, so that in order to achieve consistent sensitometric results, adjustments in the development process and solution may be necessary depending on the position of the process on the depletion/replenishment cycle.

Although the potential benefits of activation processing have long been recognised in the field of graphic arts films and plates, they have not hitherto been exploited in the field of X-ray films, least of all in laminar-grain X-ray films. In the case of graphic arts films, activation processing has not found widespread use due to problems such as high Dmin, low Dmax, low contrast, poor hardening, and staining. Generally speaking, the technique has not proved commercially viable except in the case of rapid-developing high-chloride fine-grain emulsions. X-ray films typically comprise coarse-grained high-bromide emulsions, and since laminar emulsions are known to be particularly prone to most of the above mentioned problems even with normal processing, it is very surprising that activation processing is possible in this case without detriment to the sensitometry.

DESCRIPTION OF PREFERRED EMBODIMENTS

In principle, any of the well-known silver halide developing agents can be used in the invention, such as the compounds listed in Research Disclosure No. 92332 (Section VI) (Dec. 1971), but in practice the preferred compounds are dihydroxybenzenes such as catechol and hydroquinone. Substituted derivatives of these compounds may be used, e.g. with substituents, such as, alkyl groups, halogen atoms, carboxylic acid groups etc. Ballasting substituents may be used, as described for example in Research Disclosure No. 17364 (1987), or the developing agent may form part of a polymer for ballasting purposes, as described in European patent Application No. 92307707.7 (filed 24th Aug. 1992). Ballasted developers have the advantage of reduced diffusion into the processing solution, and hence reduced polluting properties, but so far the unsubstituted compounds have given the best sensitometric results, and hydroquinone itself is the most preferred developer. "Masked" developers, where the active developing species is released by reaction with the alkaline activator solution, may also be used. Such materials are described in Canadian Patent No. 766708 and generally comprise easily-hydrolysed esters of hydroquinone and analogous compounds.

The concentration of developer in the coated layer is generally equivalent to at least 0.4 moles per mole of the silver coated on the same side of the base, preferably at least 0.5 moles per mole of silver, more preferably at least 0.75 moles per mole of silver, most preferably at least 1.0 moles per mole of silver. In theory there is no upper limit to the amount of developer to be used, but in practice it is found that concentrations greater than about 1.5 moles/mole Ag give no further increase in Dmax or speed, and indeed may interfere with the adhesion of the layer to the base. Also, as larger amounts of developer are added, the thickness of the relevant colloid layer increases, which may cause drying problems. A range of 0.4 to 2.0 moles per mole of silver coated on the same side of the base therefore represents a reasonable operating range.

The developer is coated in one or more layers, preferably one layer, distinct from the silver halide emulsion layer(s). Although the prior art on activation development of graphic arts films generally advocates incorporation of the developer in the emulsion layer itself, this is found to be unsuitable for the present invention, causing unacceptably high fog. Normally, in the practice of the present invention the developer layer is situated between the base and the emulsion.

The developer is coated as a solution or dispersion in an aqueous colloid, normally gelatin, although this may be blended with other materials, such as, dextran, poly(ethyl acrylate), poly(vinyl alcohol), etc. The developer layer may be hardened with any of the well-known hardening agents such as formaldehyde, vinyl sulphones, triazine derivative etc. but rapid hardeners such as divinyl sulphone are preferred.

The developer layer may also contain an auxiliary developer, also known as an electron transfer agent or super additive developer. Such materials are well known in the art and serve to increase significantly the speed and efficiency of the development process. They are generally used in much lower concentrations than the primary developer, and in the context of this invention a suitable concentration is in the range 4 to 25, preferably 8 to 15 millimoles per mole of silver coated on the same side of the base. The use of auxiliary developers is described, for example, in "The Theory of the Photographic Process" (4th ed.) (ed. T. H. James) chapter 14(II), p.432, and any of the compounds mentioned therein may be used, but the preferred auxiliary developer is phenidone. As an alternative, or in addition, to placement in the developer layer, an auxiliary developer may be added to the activator solution used to process the film.

Laminar grain emulsions, also known as tabular emulsions, are well known in the art. A laminar emulsion is one in which at least 50% of the grains have an aspect ratio i.e. ratio of diameter to thickness of 3:1 or greater. There is no particular upper limit for the aspect ratio (AR), but values greater than about 15:1 are uncommon. A preferred AR range is 3:1 to 12:1, most preferably from about 5:1 to 8:1.

Any of the known methods for preparing such emulsions may be used, but a preferred method is described in U.S. Pat. No. 5,028,521. The grains may comprise chloride, bromide or iodide ions in any combination, including those in which the different halide ions are distributed unevenly within individual grains, i.e. core-shell emulsions or epitaxial-growth emulsions. Preferably the grains are predominantly silver bromide (e.g. at least 60% bromide), most preferably silver iodobromide with a maximum iodide content of 3.5 mol %. Typical grain sizes are in the range 0.2 to 3.0 microns diameter and 0.05 to 0.3 microns thickness.

The emulsion is preferably chemically sensitised by any of the conventional methods, and spectrally sensitised to match the output of the intended phosphor screens (normally green or blue). Any of the commonly used sensitising dyes may be used for this purpose. The emulsion may also contain further ingredients such as antifoggants, hardeners, stabilisers, preservatives, surfactants etc., in accordance with known techniques.

The base normally comprises polyester (clear or blue tinted) of 50 to 200 microns thickness. It may be surface-treated and/or subbed by any of the conventional methods to increase the wettability and adhesion of the coated layers.

The developer and emulsion layers may be coated by any of the standard methods, but are most conveniently coated simultaneously via a multislot coater. Typical silver coating weights are in the range of 1 to 5 g/m2 on each side. Preferably a protective top layer is included comprising gelatin and a relatively high concentration of hardener. Antihalation and/or filter dyes may be incorporated in an underlayer nearest to the base, or such dyes may be incorporated in the developer layer. Suitable dyes absorb strongly at the wavelength of the exposing light (the wavelength of maximum sensitivity of the emulsion), but must bleach or wash out completely during processing of the film. Suitable dyes are disclosed, for example, in U.S. Pat. Nos. 4,900,652, 5,028,520 and 5,079,134.

The photographic elements of the invention may be exposed using conventional X-ray imaging equipment and appropriate phosphor screens. Processing is effected by contacting the exposed emulsion(s) with an alkaline activator solution. Activator solutions are well known in the art, a commercially available example being "RAPIDOPRINT", sold by Agfa for use with graphic arts films. A typical activator comprises an aqueous solution of an alkaline material, e.g. KOH, NaOH, $NH_4OH$, $K_2CO_3$, $Na_2CO_3$ etc., together with a preservative such as sodium sulphite and optionally, a restrainer such as sodium bromide. The activator solution generally has a pH in the range 8 to 14, but preferably at least 9, more preferably at least 10.5. The activation development may be carried out at various temperatures, e.g., at a temperature in the range 10 to 40° C. and for various times. Development times of less than 10 seconds are readily achieved.

The activator solutions may be applied to the film by any of the known methods such as dipping, spraying, transfer from roller etc. The film may be immersed in a comparatively large volume of activator, or a thin film of activator may be applied to the surface of the film. Surfactants and/or thickening agents may be added to the activator solution to improve the efficiency of contact with the film surface. Following the activation development process, the film is subjected to fixing, washing and drying in the normal manner. The entire process can be carried out in 45 seconds or less, dry-to-dry.

The films can be processed in conventional developer solutions, but there is no particular advantage in doing so.

The invention will now be illustrated by the following Examples.

GLOSSARY

The following abbreviations and trade names are used in the Examples:

HOSTAPUR—wetting agent available from Hoechst (10% aqueous solution).

DEXTRAN 40—polysaccharide available from Fisons.

PEA—poly(ethyl acrylate) (aqueous dispersion).

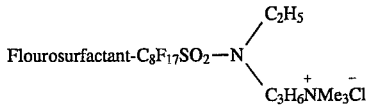

Sp-1—log speed at density 0.25 above base+fog.

Sp-2—log speed at density 1.0 above base+fog.

Sp-3—log speed at density 3.0 above base+fog.

Acon—average contrast at density 0.25 to 2.0 above base+fog.

C.W.—total silver coating weight (i.e. both sides) in g/m$^2$.

DN—Dornberg Number (an indication of hardness, measured by standard techniques).

XP505—conventional X-ray film processor, available from Minnesota Mining and Manufacturing Company.

XAD3—conventional X-ray film processing chemistry, available from Minnesota Mining and Manufacturing Company.

RA—"Rapidoprint" activation processor, available from Agfa (with 8 second activation cycle and 22 second fix/wash cycle).

The emulsions were prepared in accordance with the method disclosed in U.S. Pat. No. 5,028,521, and were chemically sensitised and spectrally sensitised (to green light) by conventional procedures.

Test exposures were of 0.1 seconds on a purpose-built double sided sensitometer equipped with two Wratten No. 99 filters, and sensitometric evaluations were performed with the aid of a modified Macbeth TR924 densitometer.

EXAMPLE 1

| (i) Developer Underlayer | | |
|---|---|---|
| a) | gelatin | 12 g |
| b) | distilled water | 190 g |
| c) | aqueous filter dye solution | 40 ml |
| d) | hydroquinone | 4.5 g |
| e) | phenidone, 4% solution in MeOH | 4.5 ml |
| f) | vinyl sulphone hardener, 1% aqueous solution | 20 ml |

Components a) to e) were mixed at 40° C. and water added to a total weight of 255 g and f) was added prior to coating.

| (ii) Emulsion Layer | | |
|---|---|---|
| a) | pure silver bromide emulsion AR = 8:1 (as in Example 12 of U.S. Pat. No. 5,028,521) | 0.4 mol |
| b) | gelatin | 6 g |
| c) | distilled water | 80 ml |
| d) | resorcinol, 20% aqueous solution | 6 ml |
| e) | azodicarbonamide M/40 in DMF | 9 ml |
| f) | Hostapur, 10% aqueous solution | 16 ml |
| g) | Dextran 40, 10% aqueous solution | 216 ml |
| h) | PEA, 10% solids aqueous dispersion | 88 ml |
| i) | vinyl sulphone hardener 1% aqueous solution | 80 ml |

Component a), b) and c) were mixed and held for 20 minutes; component d) was added and held for 15 minutes and thereafter component e) to h) were added and held for 30 minutes before adjusting the pH to 6.7 and adding distilled water to give a total weight of 880 g. The hardener was added prior to coating.

| (iii) Topcoat | | |
|---|---|---|
| a) | gelatin | 50 g |
| b) | distilled water | 800 g |
| c) | Hostapur, 10% aqueous solution | 24 ml |
| d) | Fluorosurfactant, 1% aqueous solution | 24 ml |
| e) | polymethylmethacrylate, 6.5% solids aqueous dispersion | 10 ml |
| f) | vinyl sulphone hardener 1% aqueous solution | 100 ml |

Components a) to e) were mixed, the pH adjusted to 6.7 and water added to bring the weight to 900 g and f) was added prior to coating.

The three solutions (i), (ii) and (iii) were applied to both sides of transparent polyester base by a multislot coater at 85/65/45 ml/min respectively at 1.5 m$^2$/min (Sample 1). A further sample was made without the developing agents, hydroquinone and phenidone (Sample 2) present.

Sample 1 with a developer underlayer contained a dye that did not bleach, so obscuring Dmin values. The hydroquinone was coated in a hydrophillic colloidal (gelatin) underlayer at a coverage of 0.93 g/m$^2$, hence about 0.45 moles/mole silver, with phenidone at 0.037 g/m$^2$. The samples were exposed and processed as reported in the following Table.

| Sample | Sp-2 | Acon | Dmax | C.W. | DN. | Processor |
|---|---|---|---|---|---|---|
| 1 | 1.83 | 2.16 | 3.71 | 4.1 | 74 | XP505 90" |
| 2 | 1.90 | 1.94 | 3.76 | 4.1 | 103 | XP505 90" |
| 1 | 1.62 | 2.22 | 3.95 | | | RA 30" + 15" drying 3M 9014 CAD Dryer = 45" |

As can be seen the contrast was improved by use of the developer underlayer. The Dmax is excellent i.e. over 3.4. The toughness of the film is also acceptable i.e. over 35 Dornberg units; which is surprising since films prepared with developer incorporated sometimes have difficulty in hardening.

EXAMPLE 2

A laminar grain crystal was used in this Example; which had an aspect ratio of 4.5:1, it was digested before the desalting step in an effort to decrease the need for hardener in the coating. The emulsion had a high Dmin. A simple $2^2$ factorial design experiment was run on the levels of hydroquinone and phenidone in the developer underlayer. The levels of each in g/m$^2$ are shown below.

| | plus | centre | minus |
|---|---|---|---|
| Hydroquinone (HQ) | 1.23 | 0.93 | 0.62 |
| Phenidone (Ph) | 0.05 | 0.037 | 0.025 |

Samples were prepared as in Example 1 except that the hardener in the emulsion layer was reduced to 40 ml, the difference in weights being corrected with water. The results for the Rapidoprint processing are:

| Sample | HQ | Ph | Dmin | Sp-2 | Acon | Dmax | DN |
|---|---|---|---|---|---|---|---|
| 3 | − | − | 0.25 | 1.83 | 2.34 | 3.42 | 90 |
| 4 | + | − | 0.26 | 1.93 | 2.45 | 3.62 | 85 |
| 5 | − | + | 0.32 | 1.91 | 2.31 | 3.72 | 93 |
| 6 | + | + | 0.32 | 1.94 | 2.42 | 3.85 | 93 |
| 7 | 0 | 0 | 0.27 | 1.94 | 2.45 | 3.76 | 98 |
| 8 | 0 | 0 | 0.29 | 1.94 | 2.33 | 3.76 | 91 |

From this set of results it is possible to identify routes to higher speed and lower Dmin. Speed is dependent both on the developer and the electron transfer agent, it will increase by 0.04 units with each 0.3 g/m2 of hydroquinone and by 0.03 with each 0.013 g/m$^2$ of phenidone. Dmin had very little dependence on hydroquinone but will increase by 0.03 units with each 0.013 g/m$^2$ increase in phenidone. Note here the quite high speed attained in this set of samples compared to Example 1. Again there is a very good Dmax even with films that are quite tough. Analysis of these Examples would predict that speed could be increased by increasing the coverage of the hydroquinone and Dmin reduced by lowering the amount of phenidone.

EXAMPLE 3

The emulsion used in Example 1 was coated with and without a developer underlayer (Samples 9 and 10) which had a wetting agent added (Hostapur) and would give a coverage of 1.45 g/m$^2$ of hydroquinone and 0.030 g/m$^2$ of phenidone. This time after coating the films were not subjected to a calidarium as in the previous Examples. This is a process which heats the film to decrease the time of hardening. Since a rapid hardener was used in the coating a calidarium is not actually required, the film being quite hard a few days after coating. The results are as follows:

| Sample | Dmin | Sp-1 | Sp-2 | Acon | Dmax | Process |
|---|---|---|---|---|---|---|
| 9 | 0.22 | 2.32 | 2.04 | 3.73 | 4.72 | XP505 90" |
| 10 | 0.19 | 2.21 | 1.93 | 3.48 | 4.24 | XP505 90" |
| 9 | 0.22 | 2.35 | 2.03 | 3.16 | 4.08 | RA 45" |

In this case the increase in speed predicted by the previous Example was verified even though this is a different emulsion. The Dmin of the invention is acceptable i.e. less than 0.23. A quite high contrast was attained with the invention with a high Dmax, over 4.0, which coupled with the rapid access capability would make this type of element suitable for a mammographic application.

This result shows the unexpected advantage of having the hydroquinone and phenidone in a discrete underlayer.

EXAMPLE 4

This Example demonstrates different binders for the developer layer. The binders employed were dextran, gelatin and PEA with a total coverage of 6 g/m$^2$. The amount of hydroquinone was kept constant at 1.45 g/m$^2$ and phenidone at 0.020 g/m$^2$.

The use of the gelatin extenders PEA and dextran allows the coating of relatively thick underlayers with a high HQ content without causing drying problems. The following coating solutions were prepared as follows:

| Sample | 11 | 12 | 13 |
|---|---|---|---|
| Gelatin | 13.9 g | 12.4 g | 15.5 g |
| water | 51 ml | 45 ml | 57 ml |
| 20% Dextran | 34.8 ml | 46.4 ml | 34.8 ml |
| 20% PEA | 19.3 ml | 15.5 ml | 11.6 ml |
| 10% Hostapur | 4 ml | 4 ml | 4 ml |
| 4% (MeOH) Phenidone | 2 ml | 2 ml | 2 ml |
| 4% Hydroquinone | 150 ml | 150 ml | 150 ml |
| pH 6.7 | | | |

| Sample | 14 | 15 | 16 | 17 |
|---|---|---|---|---|
| Gelatin | 10.8 g | 10.8 g | 13.9 g | 9.3 g |
| water | 39 ml | 39 ml | 51 ml | 32 ml |
| 20% Dextran | 58.0 ml | 52.2 ml | 40.6 ml | 58.0 ml |
| 20% PEA | 11.6 ml | 17.4 ml | 13.5 ml | 19.3 ml |
| 10% Hostapur | 4 ml | 4 ml | 4 ml | 4 ml |
| 4% (MeOH) Phenidone | 2 ml | 2 ml | 2 ml | 2 ml |
| 4% Hydroquinone | 150 ml | 150 ml | 150 ml | 150 ml |
| pH 6.7 | | | | |

The following emulsion formulation was used:

| | |
|---|---|
| emulsion (as in Example 1) | 311 g |
| azodicarbonamide (M/40 in DMF) | 9 ml |
| Hostapur (10 wt %) | 14.4 ml |
| Dextran (20 wt % solution) | 108 ml |
| PEA (20% solids dispersion) | 44 ml |

The ingredients were mixed, the pH adjusted to 6.7, and the weight made up to 960 g with water.

The following topcoat formulation was used:

| | |
|---|---|
| gelatin | 25 g |
| water | 700 ml |
| fluorosurfactant (1% solution) | 24 ml |
| Hostapur (10% solution) | 24 ml |
| polymethylmethacrylate (6.5% solids dispersion) | 20 ml |
| vinyl sulphone hardener (1% solution) | 200 ml |

The first five ingredients were mixed, the pH adjusted to 6.7 and the weight to 800 g, and the hardener added prior to coating. (No hardener was added to the developer or emulsion layers).

Each developer formulation was coated in turn on both sides of subbed polyester base along with emulsion and topcoat formulations at pump rates of 40, 62 and 100 ml/mn respectively at a speed of 1.5 sq.m/min.

The coated samples were dried and evaluated as before.

The results showed the robustness of the sensitometric results to gross changes in binder compositions since all values of Dmin, speed, etc., were identical within normal experimental error.

The samples were compared with a Fuji S-HRG film which is representative of current diagnostic film. Since the sensitometry was the same for all samples of the invention, only one Example is presented here and compared to S-HRG film.

| Sample | Dmin | Sp-1 | Sp-2 | Sp-3 | Acon | Dmax | C.W. | Process |
|---|---|---|---|---|---|---|---|---|
| 16 | 0.21 | 2.39 | 2.05 | 1.53 | 3.28 | 4.16 | 3.5 | XAD3 110" |
| S-HRG | 0.24 | 2.38 | 2.05 | 1.34 | 2.89 | 3.79 | 3.7 | XAD3 110" |
| 16 | 0.21 | 2.32 | 2.01 | 1.52 | 3.22 | 4.13 | | XAD3 60" |
| S-HRG | 0.23 | 2.32 | 1.98 | 1.15 | 2.63 | 3.80 | | XAD3 60" |
| 16 | 0.21 | 2.16 | 1.83 | 1.14 | 2.84 | 3.92 | | RA 45" |
| S-HRG | | | No development | | | | | RA 45" |

The sample of the invention shows Dmin, speed, contrast, Dmax, coating weight and processing latitude advantages over the Fuji film. The sample of the invention can also be processed in an activator (RA) processor.

We claim:

1. A method of forming an image comprising the steps of:

providing an X-ray film comprising a transparent base coated on at least one side with (a) a laminar grain silver halide emulsion and (b) separate hydrophilic colloid layer containing a developing agent for silver halide in an amount corresponding to at least 0.75 moles of developing agent per mole of silver halide in said laminar grain silver halide emulsion, positioning a light-emitting phosphor screen in intimate contact with each emulsion-coated side of said film, imagewise exposing said phosphor screen to X-rays, and contacting the exposed film with an aqueous alkaline activator solution to develop an image.

2. A method of forming an image according to claim 1 wherein said activator solution has a pH of at least 9.

3. A method of forming an image according to claim 2 wherein said activator comprises a member selected from the group consisting of KOH, NaOH, $NH_4OH$, $K_2CO_3$, $Na_2CO_3$ and mixtures thereof.

4. A method of forming an image according to claim 1 wherein said activator solution comprises a preservative and/or restrainer.

5. A method of forming an image according to claim 4 wherein said activator solution comprises sodium sulphate and/or sodium bromide.

6. A method of forming an image according to claim 1 wherein said activator solution comprises an electron transfer agent.

7. A method of forming an image according to claim 6 wherein said electron transfer agent is phenidone.

8. The method of claim 1 wherein said developing agent is present in an amount corresponding to at least 1.0 moles of developing agent per mole of silver halide in said laminar grain silver halide emulsion.

9. The method of claim 1 wherein said layer (b) contains an electron transfer agent.

10. The method of claim 1 wherein said electron transfer agent comprises phenidone.

* * * * *